US007431294B2

(12) United States Patent
Taniguchi

(10) Patent No.: US 7,431,294 B2
(45) **Date of Patent: *Oct. 7, 2008**

(54) SHEET TRANSPORT PATH SWITCHING MECHANISM

(75) Inventor: Susumu Taniguchi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/799,116

(22) Filed: May 1, 2007

(65) Prior Publication Data

US 2007/0205552 A1 Sep. 6, 2007

Related U.S. Application Data

(62) Division of application No. 10/832,907, filed on Apr. 27, 2004, now Pat. No. 7,216,866.

(30) Foreign Application Priority Data

Apr. 28, 2003 (JP) ..... 2003-124267

(51) Int. Cl.
*B65H 39/10* (2006.01)

(52) U.S. Cl. ..... 271/303

(58) Field of Classification Search ..... 271/303, 271/305; 399/399, 401

See application file for complete search history.

(56) References Cited

U.S. PATENT DOCUMENTS

| | | | | |
|---|---|---|---|---|
| 3,310,304 | A | 3/1967 | Foias et al. | |
| 5,028,046 | A | 7/1991 | Kuwahara | |
| 5,655,765 | A | 8/1997 | Asami et al. | |
| 6,398,212 | B1 | 6/2002 | Miyake | |
| 6,565,274 | B1 | 5/2003 | Lyons | |
| 6,840,384 | B2 | 1/2005 | Yurko | |
| 6,926,272 | B2 | 8/2005 | Carter et al. | |
| 7,216,866 | B2 * | 5/2007 | Taniguchi | 271/303 |
| 2002/0135124 | A1 | 9/2002 | Suzuki et al. | |
| 2005/0035540 | A1 | 2/2005 | Carter et al. | |

FOREIGN PATENT DOCUMENTS

| | | |
|---|---|---|
| JP | 11-130314 | 5/1999 |
| JP | 2000-211773 | 8/2000 |
| JP | 2001-316017 | 11/2001 |

* cited by examiner

*Primary Examiner*—David H Bollinger
(74) *Attorney, Agent, or Firm*—Gerald E. Hespos; Anthony J. Casella

(57) ABSTRACT

A sheet transport path switching mechanism includes a movable guide to be moved rotatably about a support shaft parallel to the width direction of a transport path so as to selectively take either a main posture where the movable guide directs a sheet to the downstream side of a main transport path relative to a branch point, and a branch posture where the movable guide directs a sheet to a branch transport path. An engagement hook is provided in an apparatus body and supports a central region in the longitudinal direction of the movable guide to prevent the movable guide from being deformed due to interference with a sheet fed toward the branch transport path. The mechanism prevents deformation of the movable guide while facilitating reduction in material and production costs and adequately meeting requirements of waste treatment.

19 Claims, 11 Drawing Sheets

SHEET TRANSPORT PATH SWITCHING MECHANISM

This application is a divisional of U.S. patent application Ser. No. 10/832,907, filed Apr. 27, 2004.

BACKGROUND OF THE INVENTION

1. Field of the Invention

The present invention relates to a sheet transport path switching mechanism suited to be applied to a sheet handling apparatus as represented by an image forming apparatus, such as copying machines, facsimile machines and various printers.

2. Description of the Related Art.

An image forming apparatus, such as copying machines and facsimile machines, is known as one type of sheet handling apparatuses. The image forming apparatus is designed such that an optically read document image is formed on a photosensitive drum as an electrostatic latent image, and a toner image obtained by supplying toner to the electrostatic latent image is transferred (developed) onto a sheet. The developed sheet obtained through the toner transfer treatment is subjected to a fixing treatment using a fixing device, and then discharged outside through a given discharging transport path.

The discharging transport path is arranged to receive the sheet from a position directly below a development unit, which is disposed at an approximately middle position of the inner space of a housing of the image forming apparatus to extend horizontally, through the fixing device. For instance, as shown in FIG. 11, such a discharging transport path 100 includes a main transport path 101 extending approximately vertically upward, and a branch transport path 102 extending horizontally from a branch point 103 located at an appropriate position of the main transport path 101, toward a side sheet-discharge port 104 formed in the side surface of the housing of the image forming apparatus.

The main transport path 101 is arranged to allow its downstream end to be connected to an upper sheet-discharge port facing to a sheet-discharge tray (not shown) formed in the upper surface of the housing. A movable guide 110 is provided at the branch point 103 to allow the subsequent transportation for a sheet P transported from the development unit to be switched between the continuing transportation by the main transport path 101 and the branched transportation by the branch transport path 102.

The movable guide 110 comprises a shaft 111 extending to get across a transport path in a direction parallel to the width direction of the transport path, and a plurality of switching fins 112 fixed to the shaft 111 to extend in a direction orthogonal thereto. Each of the switching fins 112 has an approximately triangular shape in side view. More specifically, the switching fin 112 has a bottom edge formed in an arc shape concavedly curved obliquely downward, and a side edge located on the inward side of the housing and formed in an arc shape convexedly curved obliquely upward. The respective lower ends of the bottom and side edges intersect with one another to form an acuminate corner.

Both ends of the shaft 111 are pivotally supported by the inner surface of the housing corresponding to the branch point 103, to allow the movable guide 110 to be rotatably moved about the axis of the shaft 111. Specifically, the movable guide 110 can be rotationally moved in opposite directions to selectively take either one of a main posture where the side edges of the switching fins 101 retire to a position capable of avoiding the interference with the main transport path 106 and a branch posture where the bottom edges of the switching fins 101 face to the branch transport path 102 (FIG. 11 shows the movable guide 110 in the branch posture).

When the movable guide 110 is set up in the main posture, the sheet P fed from the fixing device to the main transport path 110 is guided by the right side-edges of the switching fins 112 in FIG. 11 to continuously pass through the main transport path 110, and then discharged from the upper sheet-discharge port to the sheet-discharge tray. Otherwise, when the movable guide 110 is set up in the branch posture, the sheet P passes through the branch transport path 102 while being guided by the bottom edges of the switching fins 112, and is then discharged outside from the side sheet-discharge port 104.

For example, the movable guide 110 is formed as a single piece through an injection molding process using a synthetic resin material to facilitate the reduction in material cost and production cost. In this case, the plurality (typically 10 to 20) of switching fins 112 become significantly deformable because they are integrated with the thin shaft 111 in a kite-train-like structure. Thus, if a relatively thick sheet P, such as a postcard, is fed to the branch point 103 where the movable guide 110 is arranged in the branch posture, it is difficult for the thick sheet P to turn around at a right angle while being guided and bent by the bottom edges of the switching fins 112. Consequently, the thick sheet P presses the bottom edges of the switching fins 112 upward to bend the shaft 111 convexedly upward. This precludes the sheet P from being properly fed toward the branch transport path 102, resulting in the occurrence of troubles, such as sheet jam.

While Japanese Patent Laid-Open Publication Nos. 11-130314 and 2000-211773 disclose a movable guide, none of the publications includes any description on the measure against the bending or deformation of the movable guide. Japanese Patent Laid-Open Publication No. 2001-316017 includes a description on one structure for preventing the deformation of a movable guide. Specifically, the Japanese Patent Laid-Open Publication No. 2001-316017 discloses a movable guide 110 having a metal reinforcing rod which is provided in the inside of a shaft 111 along the axis thereof to prevent the movable guide 110 from being deformed so as to avoid the occurrence of the aforementioned trouble.

However, the conventional movable guide 110 incorporating the metal reinforcing rod in the Japanese Patent Laid-Open Publication No. 2001-316017 involves problems of the increase in material cost due to the reinforcing rod, and the increase in production cost caused by the need for boring a through-hole over the entire longitudinal length of a produced movable guide along the axis of a shaft, and inserting the reinforcing rod into the through-hole.

Furthermore, in the above movable guide, the metal reinforcing rod is mixed with the synthetic resin body. Thus, when the movable guide is discarded, it is difficult to sort out the discarded components by materials. It is hard to say that the movable guide is desirable in view of waste treatment.

SUMMARY OF THE INVENTION

It is an object of the present invention to provide a sheet transport path switching mechanism which is free from the problems residing in the prior art.

According to an aspect of the present invention, a sheet transport path switching mechanism comprises a movable guide disposed in a sheet transport path inside an apparatus body and adapted to allow its angular posture to be changed so as to selectively direct a sheet in either one of two different directions, and a restriction member for restricting the bending of the movable guide. The restriction member is located at a position of the apparatus body corresponding to an approximately central region in the longitudinal direction of the movable guide.

Other features and advantages of the present invention will be apparent from the accompanying drawings and from the detailed description.

BRIEF DESCRIPTION OF THE DRAWINGS

FIGS. 2A and 2B show one example of a movable guide applied to the transport path switching mechanism according to the first embodiment, wherein FIG. 2A is a perspective view of the movable guide, and FIG. 2B is a sectional view taken along the line 2B-2B in FIG. 2A.

FIGS. 6A and 6B are explanatory views of the function of a transport switching mechanism of the present invention, wherein FIG. 6A is a sectional side view showing the upper portion of the rear cover having a movable guide set up in a main posture, and FIG. 6B is a sectional side view showing the upper portion of the rear cover having the movable guide set up in a branch posture.

DETAILED DESCRIPTION OF THE PREFERRED EMBODIMENTS

Figure 1:
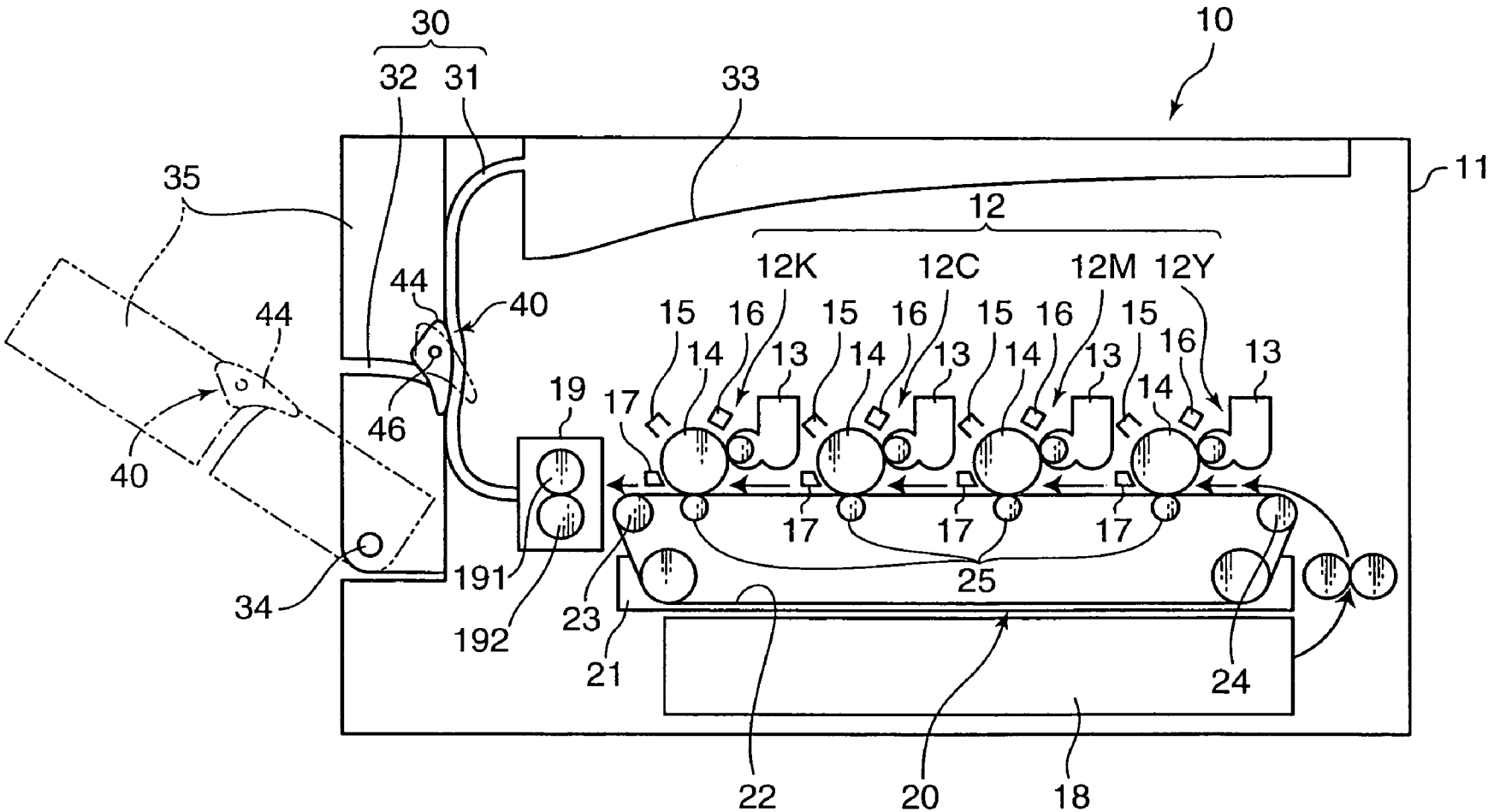
FIG. 1 is an explanatory schematic side view showing an image forming apparatus incorporating a transport switching mechanism according to a first embodiment of the present invention.

FIG. 1 is an explanatory schematic side view showing an image forming apparatus incorporating a transport switching mechanism according to a first embodiment of the present invention. As shown in FIG. 1, an image forming apparatus 10 fundamentally comprises a apparatus body 11 which contains an image forming unit 12, a sheet feeding mechanism 18 for feeding a sheet to the image forming unit 12, and a fixing device 19 for subjecting the sheet fed from the image forming unit 12 to an image fixing treatment.

The image forming unit 12 is operable to form a toner image on a sheet fed from the sheet feeding mechanism 18. In this embodiment, the image forming unit 12 includes a yellow unit 12Y, a magenta unit 12M, a cyan unit 12C and a black unit 12K, which are arranged in this order from the upstream side (the right side in the drawing sheet of FIG. 1) toward the downstream side.

Each of the units 12Y, 12M, 12C, 12K is provided with a development device 13 and a photosensitive drum 14. Each of the photosensitive drums 14 is designed to receive toner from the corresponding development device 13, and rotate clockwise in FIG. 1.

As seen in FIG. 1, a charging section 15 is provided on the upper leftward side of each of the photosensitive drums 14, and an exposing section 16 is provided on the upper rightward side of each of the photosensitive drums 14. Each of the charging sections 15 is operable to electrostatically charge the peripheral surface of the corresponding photosensitive drum 14 uniformly, and each of the exposing section is operable to emit a LED light based on image data entered from a read device (not shown) onto the electrostatically charged peripheral surface of the corresponding photosensitive drum 14 to form an electrostatic latent image on the peripheral surface of the photosensitive drum 14. Each of the development devices 13 is operable to supply toner from a toner container thereof onto the electrostatic latent image on the peripheral surface of the corresponding photosensitive drum 14 to form a toner image on the peripheral surface of the photosensitive drum 14.

A transport unit 20 is disposed below the photosensitive drums 16. The transport unit 20 comprises a base 21, and a transport belt 22 supported by the base 21 to circularly move counterclockwise in FIG. 1. As seen in FIG. 1, the transport belt 22 is wound around a drive roller 23 disposed on the left end of the base 21, a driven roller 24 disposed on the right end of the base 21, and a given number of idle rollers 25 disposed between the drive roller 23 and the driven roller 24 at even pitches, so as to go around them according to the rotational driving force of the drive roller 23.

Each of the idle rollers 25 is pressed to the corresponding photosensitive drum 14 through the transport belt 22 to allow the toner image on the photosensitive drum 14 to be reliably transferred to a sheet transported by the transport belt 22. A cleaning mechanism 17 is provided on the lower leftward side of each of the photosensitive drums 14 in FIG. 1, to remove and clean residual toner on the peripheral surface of the photosensitive drum 14. The portion of the peripheral surface of the photosensitive drum 14 subjected to the cleaning treatment using the cleaning mechanism 17 will be moved to the charging section 15, and newly subjected to the charging treatment.

A sheet fed from the sheet feeding mechanism 18 as indicated by the arrows in FIG. 1 is fed between the photosensitive drums 14 and the corresponding idle rollers 25 while being guided by the movement of the transport belt 22, and sequentially subjected to the transfer treatments according to the units 12Y, 12M, 12C, 12K. After the completion of the transfer treatment at the black unit 12K, the sheet is introduced into the fixing device 19 having a heat roller 191 and a pressure roller 192 disposed opposed to the heat roller 191. In the fixing device 19, the toner image is fixed onto the sheet through a thermal fixing treatment for pressingly nipping the sheet between the heat roller 191 and the pressure roller 192 while heating it therebetween, so that a stable color image is formed on the sheet. After the completion of the fixing treatment, the sheet with the color image is discharged outside through a transport path 30.

The transport path 30 includes a main transport path 31 extending approximately horizontally just from the downstream side of the fixing device 19 and then extending approximately straight upward through a curved portion, and a branch transport path 32 branched from the main transport path 31 to extend outward (leftward in FIG. 1). The downstream end (upper end) of the main transport path 31 faces to a sheet-discharge tray 33 formed in the upper surface of the apparatus body 11. Thus, a sheet fed through the main transport path 31 is discharged to the sheet-discharge tray 22, and whereas a sheet directed to the branch transport path 32 is discharged outside from a side opening.

The apparatus body 11 is provided with a rear cover 35 on the rear side (left side in FIG. 1) thereof. The rear cover 35 is designed to be rotatably moved in opposite directions about a horizontal shaft 34 extending in the width direction of the apparatus body (a direction orthogonal to the drawing sheet of FIG. 1) so as to selectively take either one of a close posture where the rear cover 35 closes the rear portion of the apparatus body 11, and an open posture where the rear cover 35 opens the rear portion of the apparatus body 11. The branch transport path 32 is formed in the rear cover 35.

In the first embodiment, a transport path switching mechanism having a movable guide 40 is provided at a branch point where the branch transport path 32 is branched from the main transport path, and on the side of the inner surface of the rear cover 35.

Figures 2A, 2B:
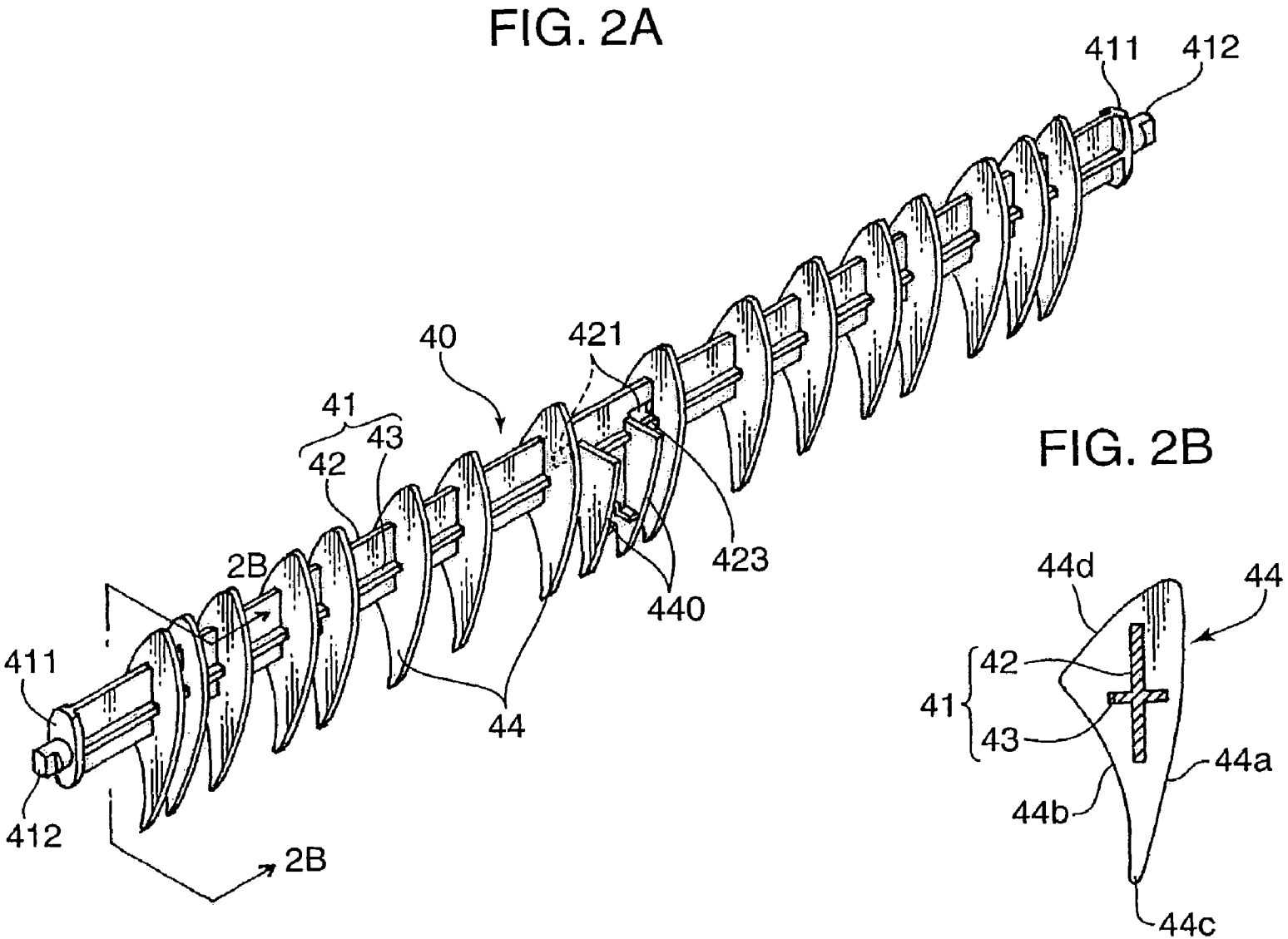

FIGS. 2A and 2B show the movable guide 40 applied to the transport path switching mechanism according to the first embodiment, wherein FIG. 2A is a perspective view of the movable guide 40, and FIG. 2B is a sectional view taken along the line 2B-2B in FIG. 2A.

As shown in FIG. 2A, the movable guide 40 comprises a cross shaft 41 having a cross shape in sectional view and a length slightly shorter than the entire length of the rear cover 35 in its width direction (a direction orthogonal to the drawing sheet of FIG. 1), a plurality of thin-plate-shaped rotary guide fins (guide members) 44 externally fitted to the cross shaft 41 and integrally fixed thereto, a pair of collar members 411 fixed, respectively, to the opposite end faces of the cross shaft 41, and a pair of support shafts 412 located concentrically with the cross shaft 41 to protrude from the collar members 411 in opposite directions, respectively.

The cross shaft 41 includes a long/wide plate (base portion) 42, and a long/narrow plate 43 crossed to the long/wide plate 42 along the longitudinally extending centerline of the long/wide plate 42. Despite of lightweight, the cross shaft 41 with the above structure becomes resistant to bending or deformation as compared to a simple circular or square shaft.

Each of the rotary guide fins 44 has an irregular triangular shape in side view. The rotary guide fin 44 is formed with a main-transport-path-use guide edge 44*a* (right edge in FIG. 2B) having an arc shape curved convexedly outward, and a branch-transport-path-use guide edge 44*b* (left edge in FIG. 2B) having an arc shape curved concavedly outward. The respective lower ends of the guide edges 44*a*, 44*b* intersect with one another to form an acuminate corner 44*c*. The rotary guide fin 44 is also formed with a rear edge 44*d* on the opposite side of the acuminate corner 44*c*.

The main-transport-path-use guide edge 44*a* acts to guide a sheet toward the downstream side of the main transport path 31 (upward in FIG. 1), and the branch-transport-path-use guide edge 44*b* acts to guide a sheet toward the branch transport path 32.

In the first embodiment, each of the rotary guide fins 44 is integrated with the cross shaft 41 in such a manner that the rear edge 44*d* of is opposed to one (upper edge in FIG. 2) of the edges of the long/wide plate 42, and the acuminate corner 44*c* is opposed to the other edge of the long/wide plate 42. Each of two of the rotary guide fins 44 located in a central region in the longitudinal direction of the cross shaft 41 is composed of a small-size rotary guide fin 440 having a cutout portion ranging from the rear edge 44*d* to the vicinity of the long/narrow plate 43 of the cross shaft 41. The small-size rotary guide fins 440 are used to avoid the interference with a component (not shown) in the rear cover 35 (e.g. wirings or detection lines of a sensor).

An escape hole (hole penetrating the base portion 42) 421 is formed in the long/wide plate 42 at each of two positions close to the long/narrow plate and between the small-size rotary guide fins 440 and the corresponding rotary guide fins 440 located on the outward side of the small-size rotary guide fins 440. Further, a portion of the long/narrow plate 43 corresponding to each of the above positions is cut out, and a column-shaped fulcrum member 422 (see FIG. 6) is provided in place of the cutout portion of the long/narrow plate 43. Each of the fulcrum members 422 is located concentrically with the support shafts 421, and a pair of after-mentioned engagement hooks (restriction member) 50 provided in the rear cover 35 are brought into engagement with the corresponding fulcrum members 422 in a latched manner. The pair of the escape holes are intended to allow the pair of engagement hooks 50 to pass therethrough in the state after the movable guide 40 is attached to the rear cover 35. An engagement portion in the present invention is comprised of the escape holes 421 and the fulcrum members 422.

The movable guide 40 is designed to be rotatably moved in opposite directions in the state after the rear cover 35 is closed, so as to selectively take either one of a main posture (see FIG. 6A) where the movable guide 40 directs a sheet from the fixing device 19 to the downstream side of the main transport path 31, and a branch posture (see FIG. 6B) where the movable guide 40 directs a sheet from the fixing device 19 to the branch transport path 32.

Figure 3:
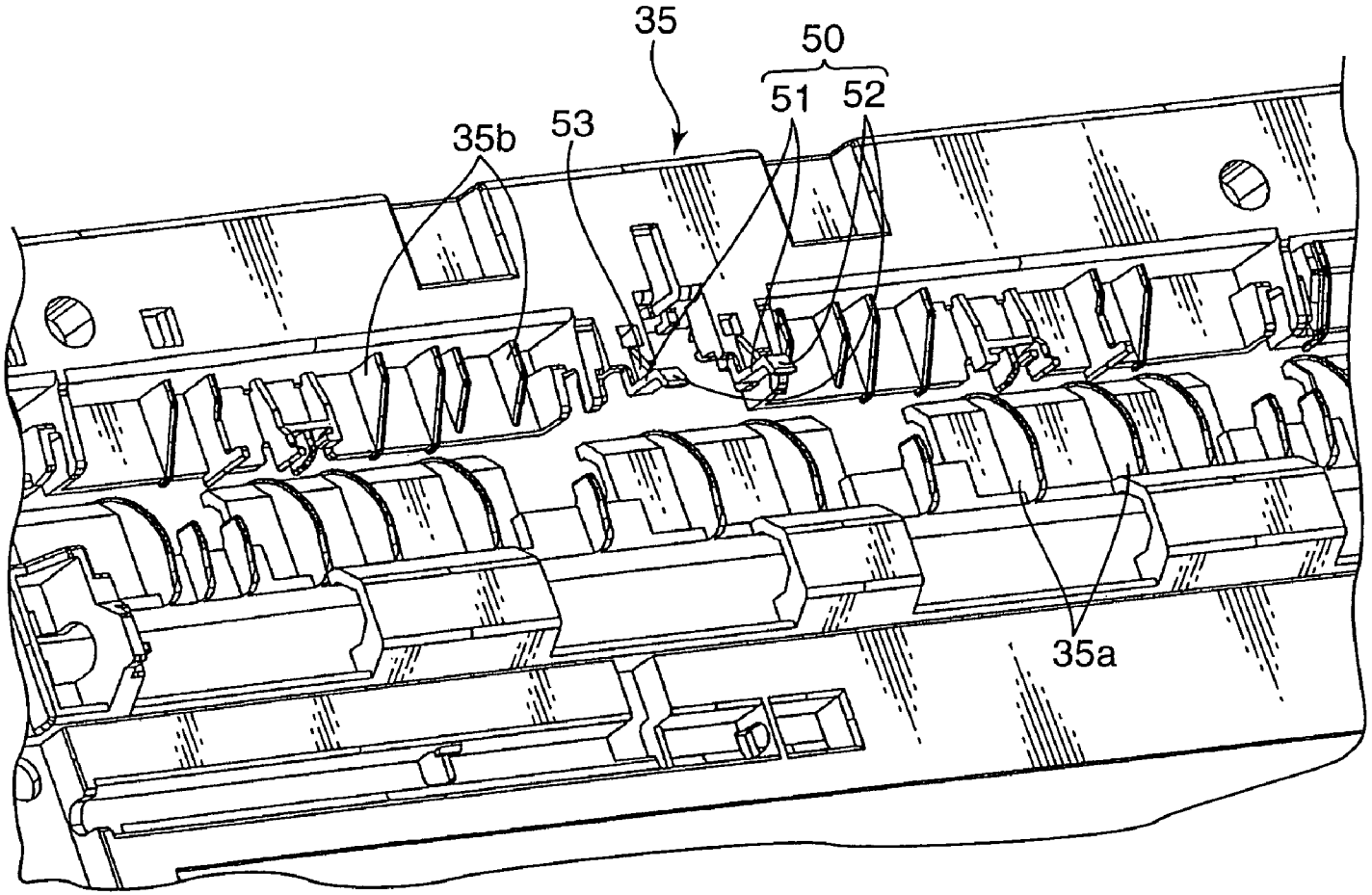
FIG. 3 is a perspective view showing the inner surface of a rear cover in the state before the movable guide is attached thereto.
Figure 4:
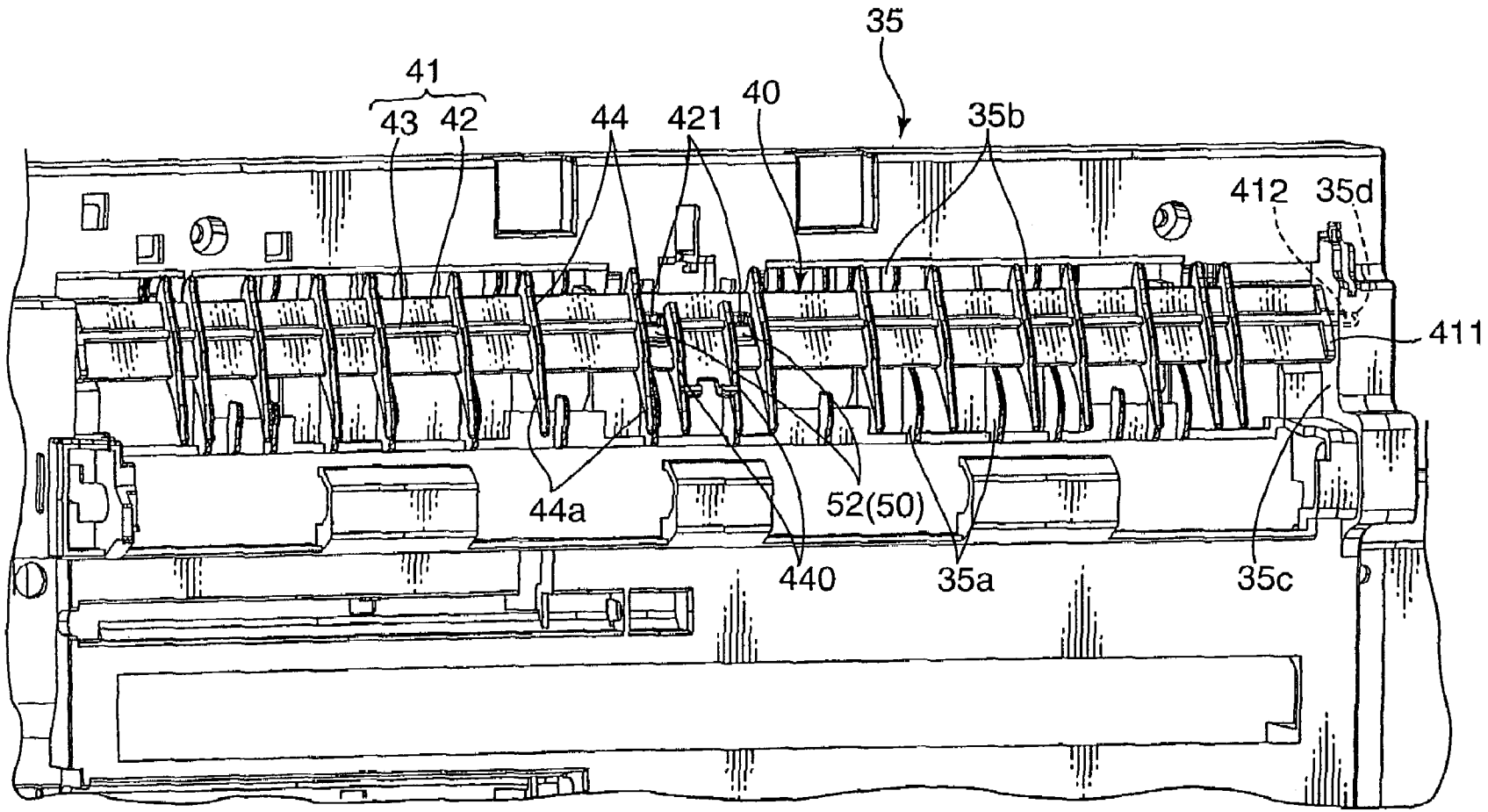
FIG. 4 is a perspective view showing the inner surface of the rear cover in the state after the movable guide is attached thereto.
Figure 5:
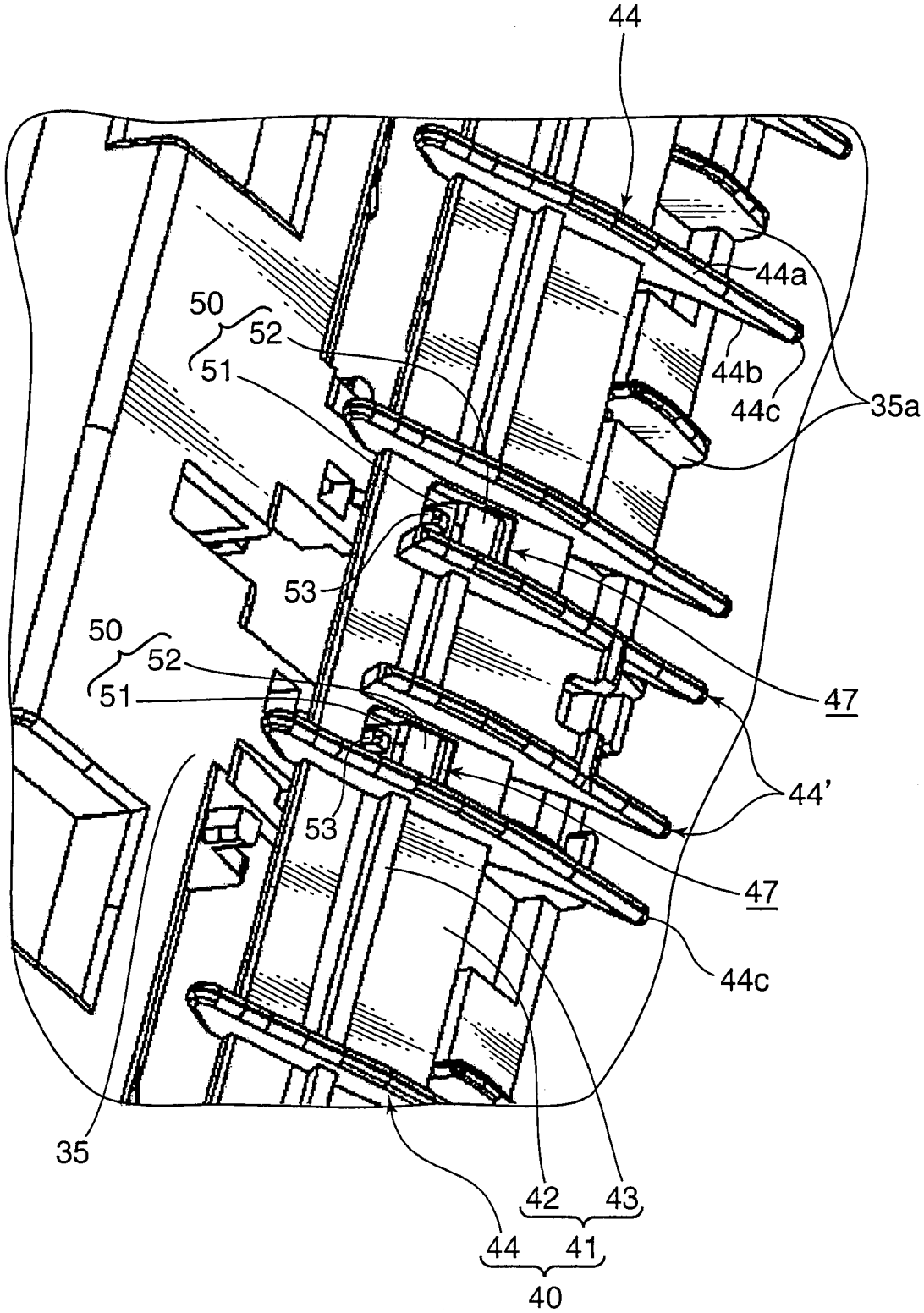
FIG. 5 is a fragmentary enlarged view of the inner surface of the rear cover in FIG. 4.

The movable guide 40 with the above structure is attached to the inner surface of the rear cover 35 in such a manner that it is rotatably moved about the support shafts 412. FIGS. 3 to 5 are perspective views showing the inner surface of the rear cover 35. FIG. 3 shows the state before the movable guide 40 is attached to the inner surface of a rear cover, and FIG. 4 shows the state after the movable guide 40 is attached to the inner surface of the rear cover. FIG. 5 is a fragmentary enlarged view of the inner surface of the rear cover in FIG. 4.

As shown in these figures, a plurality of first stationary fins 35*a* and a plurality of second stationary fins 35*b* are standingly provided on the inner surface of the rear cover 35. The first stationary fins 35*a* are arranged corresponding to the branch-transport-path-use guide edges 44*b* of the rotary guide fins 44. In the state after the rotary guide fins 44 are set up in the branch posture (see FIGS. 5 and 6B), a gap between the branch-transport-path-use guide edges 44*b* and the corresponding edges of the first stationary fins 35*a* defines the proximal or starting end of the branch transport path 32.

The second stationary fins 35*b* serve as one member for defining a portion of the main transport path 31 downstream of the movable guide 40. Each of the second stationary fins 35*b* is designed to have a shape allowing the edge of the second fin 35*b* to be approximately flush with the corresponding main-transport-path-use guide edges 44*a* of the rotary guide fin 44 (see FIG. 6A) in the state after the rotary guide fins 44 are set up in the main posture.

As shown in FIG. 4, each of side plates 35*c* of the rear cover 35 is formed with an insertion hole 35*b* for fittingly receiving the support shaft 412 therein. The support shafts 412 can be fittingly inserted into the corresponding insertion holes 35*b* to allow the movable guide 46 to be rotatably moved in opposite directions so as to selectively take either one of the main posture and the branch posture. Each of the side plates 35*c* contains a rotational drive mechanism for rotationally moving the support shafts 412. The rotational drive mechanism is designed to be activated in response to the operation of a selector switch (not shown) so as to selectively change the posture of the movable guide 40.

A pair of engagement hooks 50 are standingly provided on the rear cover at respective positions opposed to the pair of escape holes 421 of the long/narrow plate 43, to support the corresponding fulcrum members 422 in the state after the movable guide 40 is attached to the rear cover 35.

Figure 6A:
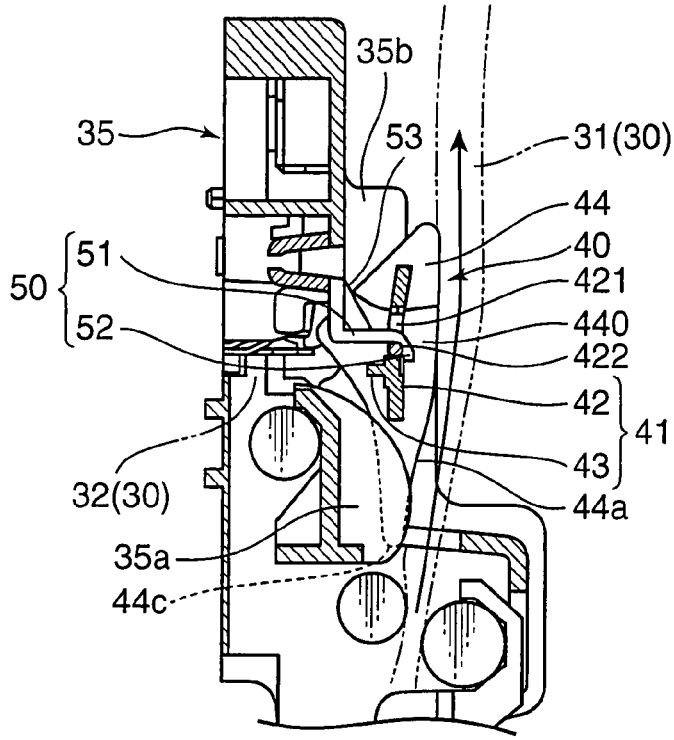
Figure 6B:
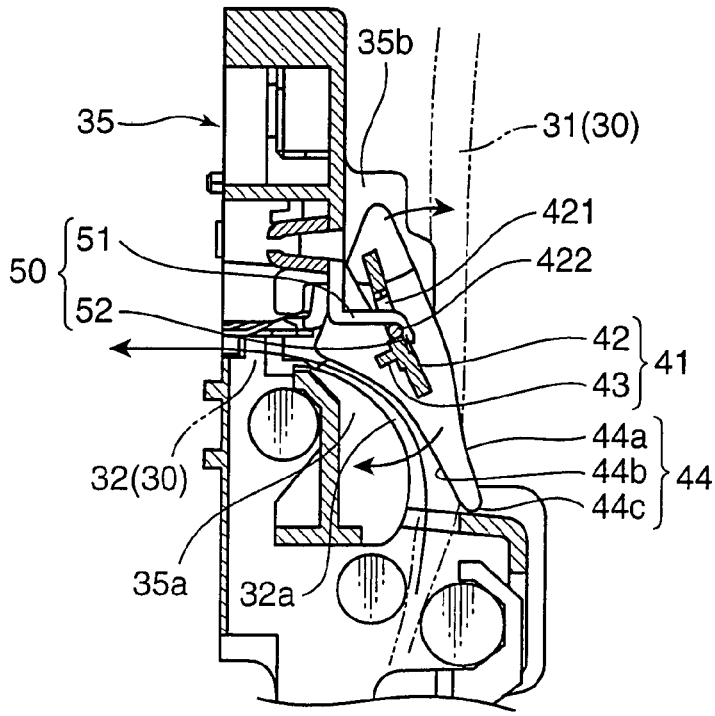

As shown in FIGS. 3, 5 and 6, each of the engagement hooks 50 comprises a standing column 51 protruding from the inner surface of the rear cover 35 in a direction approximately orthogonal to the inner surface of the rear cover 35, and an engagement finger extending from the top end of the standing column 51 to cover over the corresponding fulcrum 422 (FIGS. 6A and 6B). A brace member 53 having a triangular shape in side view is bridged between the inner surface of the rear cover 35 and the standing column 51 to provide enhanced strength of the standing column 51.

In the state after the movable guide 40 is attached to the rear cover 35, the engagement hooks 50 are arranged such that they are located opposed to the corresponding escape holes 421 of the long/wide plate 42 of the cross shaft 41, and the standing columns 51 are arranged such that the front ends thereof are brought into contact with the corresponding fulcrum members 422, as shown in FIGS. 6A and 6B.

Thus, in the state after the movable guide 40 is attached to the rear cover 35 (FIG. 4), the engagement finger 52 penetrating the escape hole 421 is in contact with the fulcrum member 422 to hold the fulcrum member 422 from above so as to reliably prevent the central region in the longitudinal direction of the movable guide 40 from being deformed upward.

With reference to FIG. 6, the function of the transport switching mechanism of the present invention will be described below. FIGS. 6A and 6B are explanatory views of the function of the transport switching mechanism of the present invention, wherein FIG. 6A is a sectional side view showing the upper portion of the rear cover 35 having the movable guide 40 set up in the main posture, and FIG. 6B is a sectional side view showing the upper portion of the rear cover 35 having the movable guide 40 set up in the branch posture.

In the state after the movable guide 40 is set up in the main posture, when the rotary guide fins 44 in the main posture are rotationally moved clockwise about the support shafts 412 (or about the fulcrum members 412) at a given angle, the acuminate corners of the rotary guide fins 44 are fitted between the adjacent first stationary fins 35*a*, so that the main transport path 31 at the branch point of the transport path 30 is opened. Thus, a sheet fed from the fixing device 19 is fed upward while being guided by the main-transport-path-use guide edges 44*a* of the rotary guide fins 44, and discharged to the sheet-discharge tray 33 (FIG. 1).

In the state after the movable guide 40 is set up in the main posture as shown in FIG. 6A, when the movable guide 40 is rotationally moved counterclockwise about the fulcrum members 412 at a given angle by rotating the support shafts 412, the movable guide 40 takes the branch posture as shown in FIG. 6B. In this state, the branch-transport-path-use guide edges 44*b* of the rotary guide fins 44 cross over the main transport path 31, and the acuminate corners 44*c* are located rightward relative to the main transport path in FIG. 6B, so that an arc-shaped gap 32*a* in communication with the branch transport path 32 is formed between the arc-shaped edges of the first stationary fins 35*a* and the branch-transport-path-use guide edges 44*b* of the rotary guide fins 44.

Thus, in the state after the movable guide 40 is set up in the branch posture, a sheet fed from the fixing device 19 toward the main transport path 31 is first brought into contact with the branch-transport-path-use guide edges 44*b* of the rotary guide fins 44. Then, the sheet is fed through the branch transport path 32 while being guided and turned by the branch-transport-path-use guide edges 44*b*, and discharged outside.

In the first embodiment, the fulcrum members 422 provided in the central region in the longitudinal direction of the movable guide 40 are pressed from above by the engagement fingers 52 of the engagement hooks 50. Thus, in the state after the movable guide 40 is set up in the branch posture, even if a thick sheet, such as a postcard, fed from the fixing device 19 presses the branch-transport-path-use guide edges 44*b* of the rotary guide fins 44 upward, the movable guide 40 is never deformed upward. Therefore, the problem of the bending precluding the adequate discharge of a sheet can be solved.

As mentioned above in detail, in the apparatus body 11 of the image forming apparatus 10 provided with the main transport path 31 extending approximately linearly and the branch transport path 32 branched from the main transport path 31 in a direction intersecting with the main transport path 31, the transport switching mechanism according to the first embodiment is provided at the branch point between the main transport path 31 and the branch transport path 32, and operable to selectively switch the sheet transport direction between the main transport path 31 and the branch transport path 32. Specifically, the transport switching mechanism includes the movable guide 40 designed to be rotatably moved about the support shafts 412 parallel to the width of each of the transport paths so as to selectively take either one of the main posture for directing a sheet from the branch point to the downstream side of the main transport path 31 and the branch posture for directing a sheet to the branch transport path 32, and the engagement hooks 50 integrated with the apparatus body 11 (in the first embodiment, the engagement hooks 50 are integrated with the apparatus body 11 through the rear cover 35) and designed to support the approximately central region in the longitudinal direction of the movable guide 40 so as to prevent the movable guide 40 set up in the branch posture from being deformed due to the interference with a sheet fed to the branch transport path 32.

Thus, even if a firm thick sheet reaches the movable guide 40 set up in the branch posture and presses the movable guide 40, the movable guide 40 having at least the longitudinally and axially central region supported by the engagement hooks 50 integral with the apparatus body 11 can effectively prevent the bending due to the interference with the sheet fed to the branch transport path 32 so as to smoothly feed the sheet toward the branch transport path 32 without occurrence of any sheet jam.

As above, the bending of the movable guide 40 is prevented by the engagement hooks 50 integral with the apparatus body 11. Thus, the movable guide 40 can eliminate the need for using a metal reinforcing rod as in the conventional transport switching mechanism, to contribute to the reduction in material cost and production cost. Further, when discarded, the movable guide 40 incorporating no metal component is desirable in view of waste treatment.

As in the first embodiment, the main transport path 31 and the branch transport path 32 may be formed to extend approximately vertically and approximately horizontally, respectively. If it is required to switch the discharge of a sheet between the upper surface of the apparatus body 11 and the side surface of the apparatus body 11, these transport paths can meet the requirement.

The movable guide 40 may be made of only a synthetic resin material. In this case, the movable guide 40 which does not use any other material, such as metal, in combination with the synthetic resin material can contribute to the reduction in material cost and production cost. Further, when discarded, the movable guide 40 is desirable in view of waste treatment.

Figure 7:
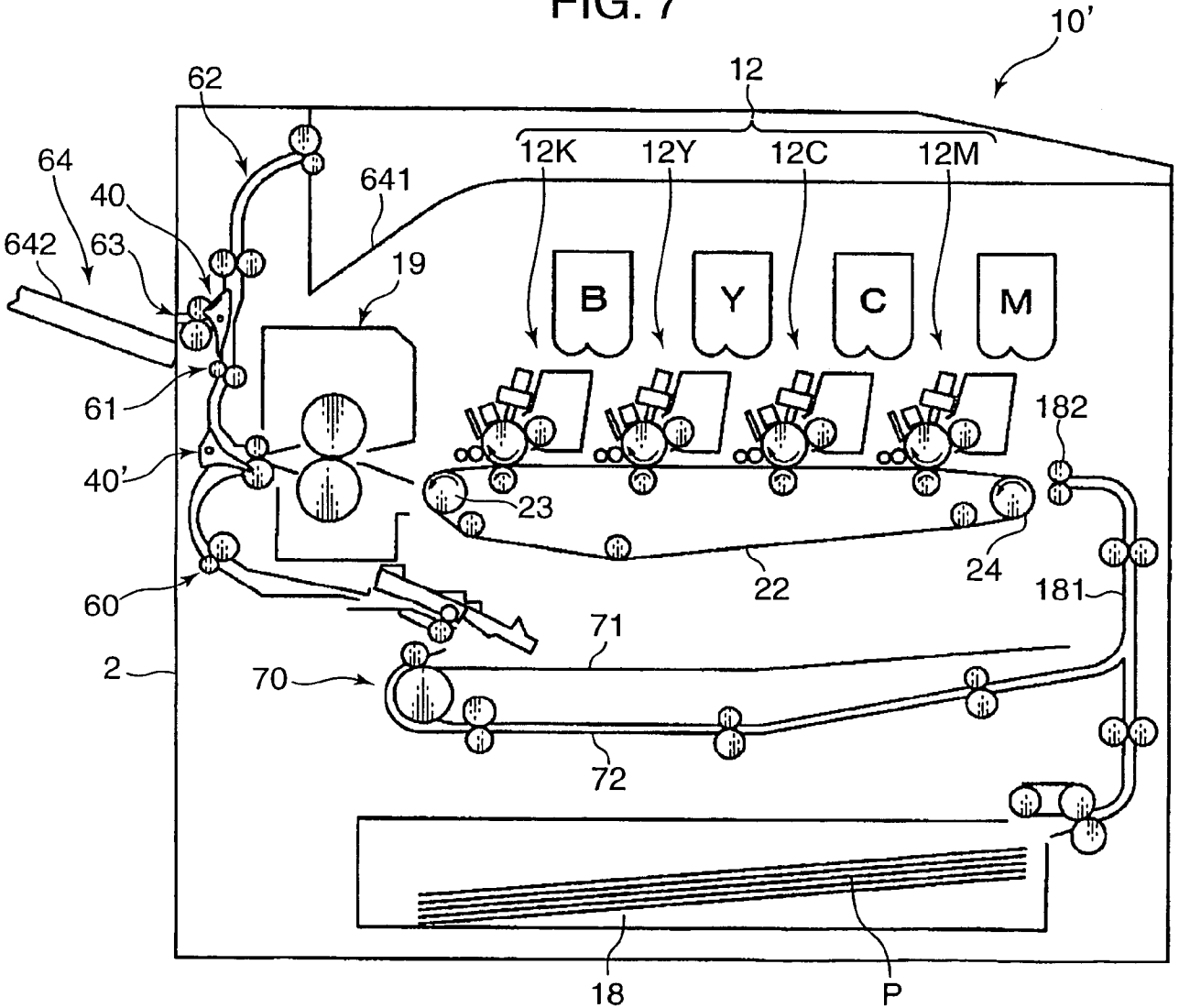
FIG. 7 is an explanatory schematic side view showing an image forming apparatus incorporating a transport switching mechanism according to a second embodiment of the present invention.
Figure 8:
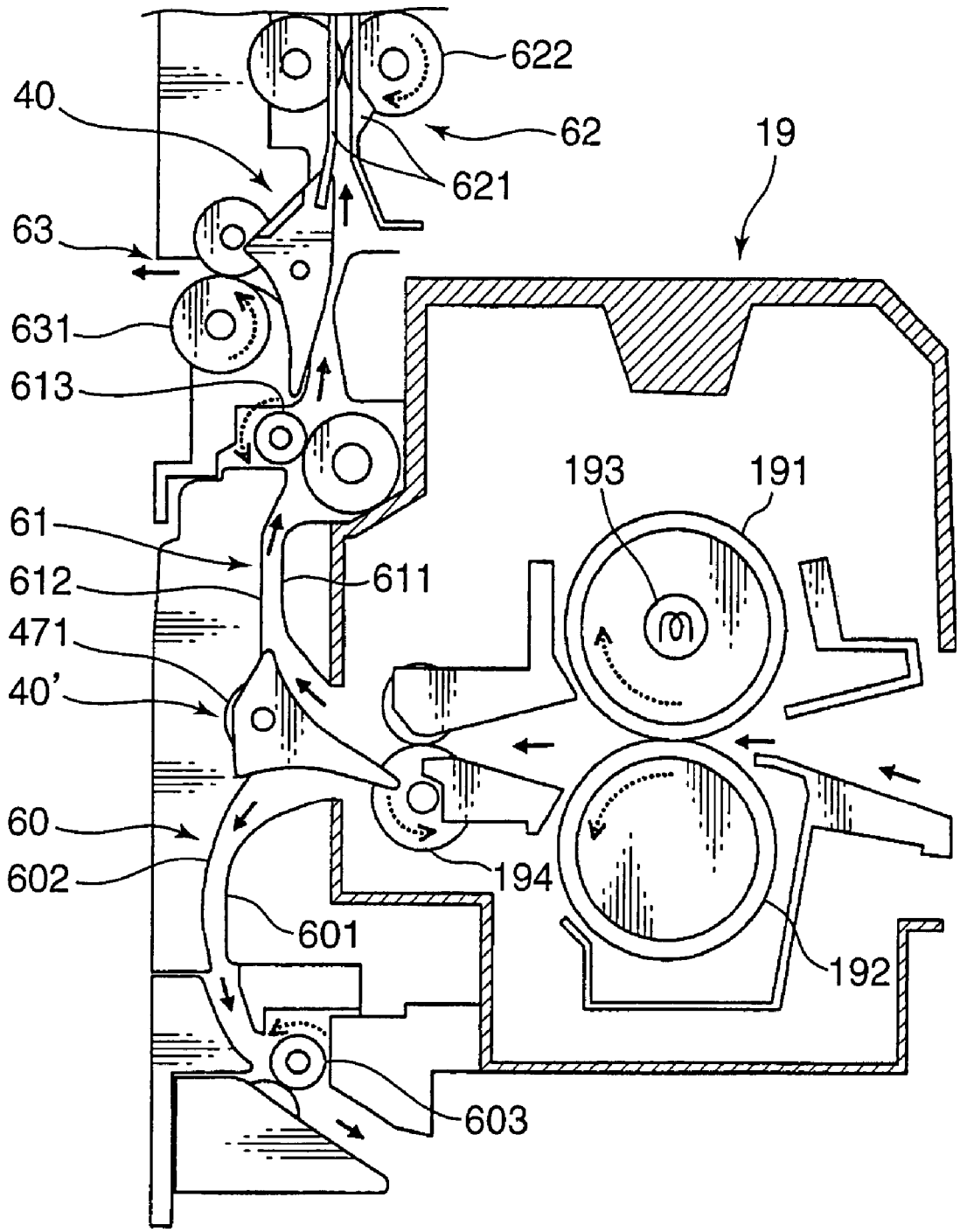
FIG. 8 is a fragmentary enlarged view of the transport switching mechanism in FIG. 7.

With reference to FIGS. 7 to 10, a transport path switching mechanism according to a second embodiment of the present invention will be described below. In FIGS. 7 to 10, the same or equivalent component as that in the first embodiment is defined by the same reference numeral or code. FIG. 7 is an explanatory schematic side view showing an image forming apparatus incorporating the transport switching mechanism according to the second embodiment of the present invention. FIG. 8 is a fragmentary enlarged view of the transport switching mechanism in FIG. 7. This embodiment employs a tandem-type color printer having a double-side printing function as an image forming apparatus.

With reference to FIG. 7, the structure of the printer as an image forming apparatus incorporating the transport switching mechanism of the present invention will first be described schematically. FIG. 7 is a schematic vertical sectional view showing an image forming apparatus 10'. The image forming apparatus 10' is designed to allow either one of a full-color image output and a monochrome image output to be selected according to color information about document image data from an external computer. In either case of full color and monochrome, an image output speed for A-4 size is set at 26 sheets/min.

The image forming apparatus 10' comprises a apparatus body 11 including a transport belt 22 disposed therein. The transport belt 22 is wound around a drive roller 23 and a driven roller 24 to transport a sheet P horizontally from the right side to the left side in FIG. 7. On the sheet receiving side of the transport belt 22, there are provided a sheet feeding mechanism 18, a feeding sheet-transport path 181 and a registration roller 182. On the sheet discharging side of the transport belt 22, there are provided a fixing device 19, a movable guide 40' in the transport switching mechanism according to the second embodiment, a reversing sheet-transport path 60, a discharging sheet-transport path 61, a facedown sheet-transport path 62, a faceup sheet-transport path 63 and a discharge section 64.

The discharge section 64 includes a first discharge tray 641 formed in the entire area of the upper surface of the apparatus body 11, and a second discharge tray 642 provided outside on the left side of the apparatus body 11 in FIG. 7. A sheet P is discharged to the first discharge tray 641 in such a manner that a printed surface of the sheet orients downward, and otherwise discharged to the second discharge tray 642 in such a manner that the printed surface orients upward.

A double-side-printing sheet-reversing section 70 is disposed between the transport belt 22 and sheet feeding mechanism 18. The double-side-printing sheet-reversing section 70 includes an intermediate tray 71 and a double-side-printing sheet-transport path 72.

An image forming unit 12 is provided above the transport belt 22. The image forming unit 12 includes a magenta unit 12M, a cyan unit 12C, a yellow unit 12Y and a black unit 12K, which are arranged in this order from the upstream side (the left side in FIG. 7). The structure and function of the image forming unit 12 are the same as those in the first embodiment, and thus their description will be omitted.

A sheet P carrying an unfixed color toner image developed by the image forming unit 12 is subjected to a fixing treatment based on heating according to a heat roller 191 in the fixing device 19. In case of a single-side printing, the sheet P subjected the fixing treatment and discharged from the fixing device 19 is directed to the discharging sheet-transport path 61 by the movable guide 40' in the second embodiment. Then, based on the switching operation of the movable guide 40 (hereinafter referred to as "upper movable guide 40") in the first embodiment, the sheet P is discharged to the first discharge tray 641 through the facedown sheet-transport path 62, or discharged to the second tray 642 through the faceup sheet-transport path 63.

In case of a double-side printing, the transport direction of a sheet P is switched to the downward direction by the movable guide 40' in the second embodiment. Then, after passing through the reversing sheet-transport path 60, the sheet P fed downward from the movable guide 40' in the second embodiment is fed into the intermediate tray 71 provided in the double-side-printing sheet-reversing section 70, from the left side to the right side in FIG. 7, and temporarily stored therein. Subsequently, the sheet P is fed backward or leftward to reverse the orientations of the front and rear surfaces of the sheet P. After passing through the double-side-printing sheet-transport path 72, the sheet P is fed into the image forming unit 12 again through the feeding sheet-transport path 181 and the registration roller 182, and subjected to a transfer treatment for the rear surface.

With reference to FIG. 8, the structures of the movable guide 40' in the second embodiment and the fixing device 10 in the image forming apparatus 10' will be described in detail. FIG. 8 is an explanatory fragmentary enlarged view of the positional relationship between the fixing device 19 and the movable guide 40', and the transport paths of a sheet P discharged from the fixing device 19. In the figure, the solid arrows indicate the transport paths of the sheet.

The fixing device 19 comprises a heat roller 191 and a pressure roller 192. The heat roller 191 is rotationally driven by a drive motor (not shown) in such a manner that the peripheral speed of the heat roller 191 becomes equal to the transport speed of the sheet. A halogen heater 193 serving as a heat source is provided in the inside of the heat roller 191. The pressure roller 192 is brought into contact with the heat roller 191 to form a nip for making the sheet pass therethrough. The pressure roller 192 is designed to follow the rotation of the heat roller 191 when it is in contact with the heat roller 191. A post-fixing transport roller 194 is provided at a position just downstream of the heat roller 191 and the pressure roller 192.

Figure 9:
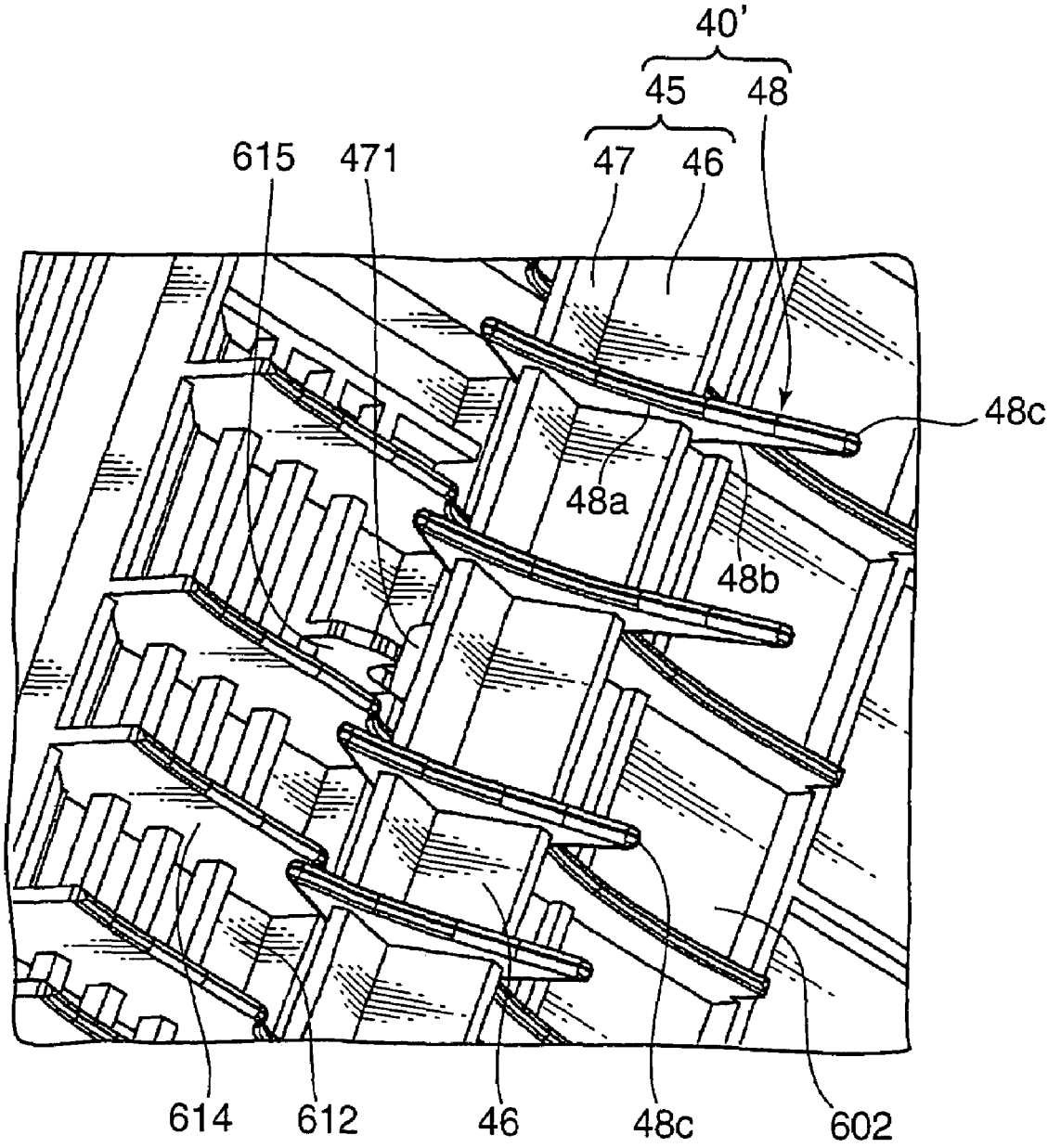
FIG. 9 is a perspective view of a movable guide 40', seeing from the side of a fixing device 19.
Figure 10:
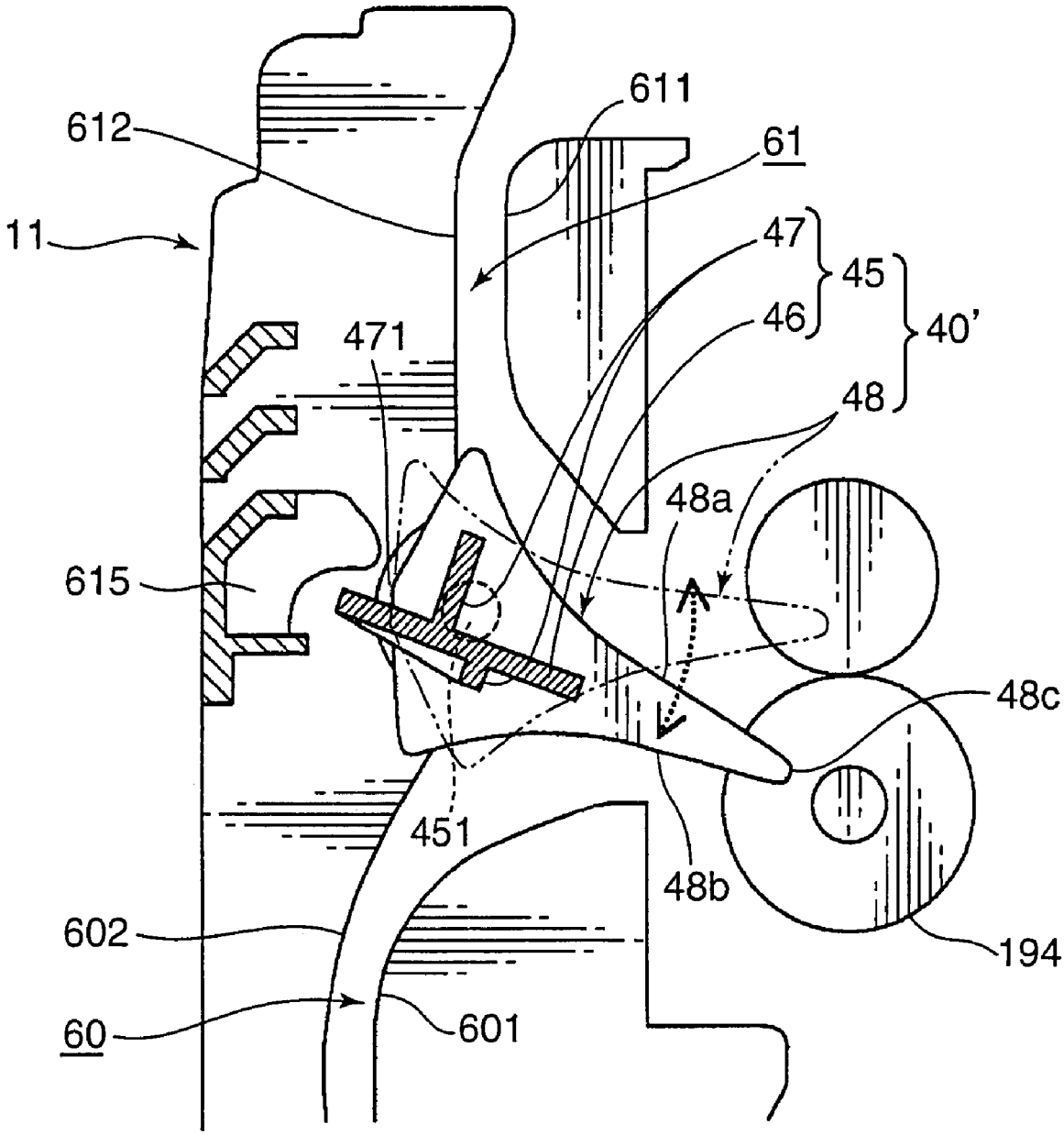
FIG. 10 is an enlarged view showing the vicinity of the movable guide in FIG. 8.
Figure 11:
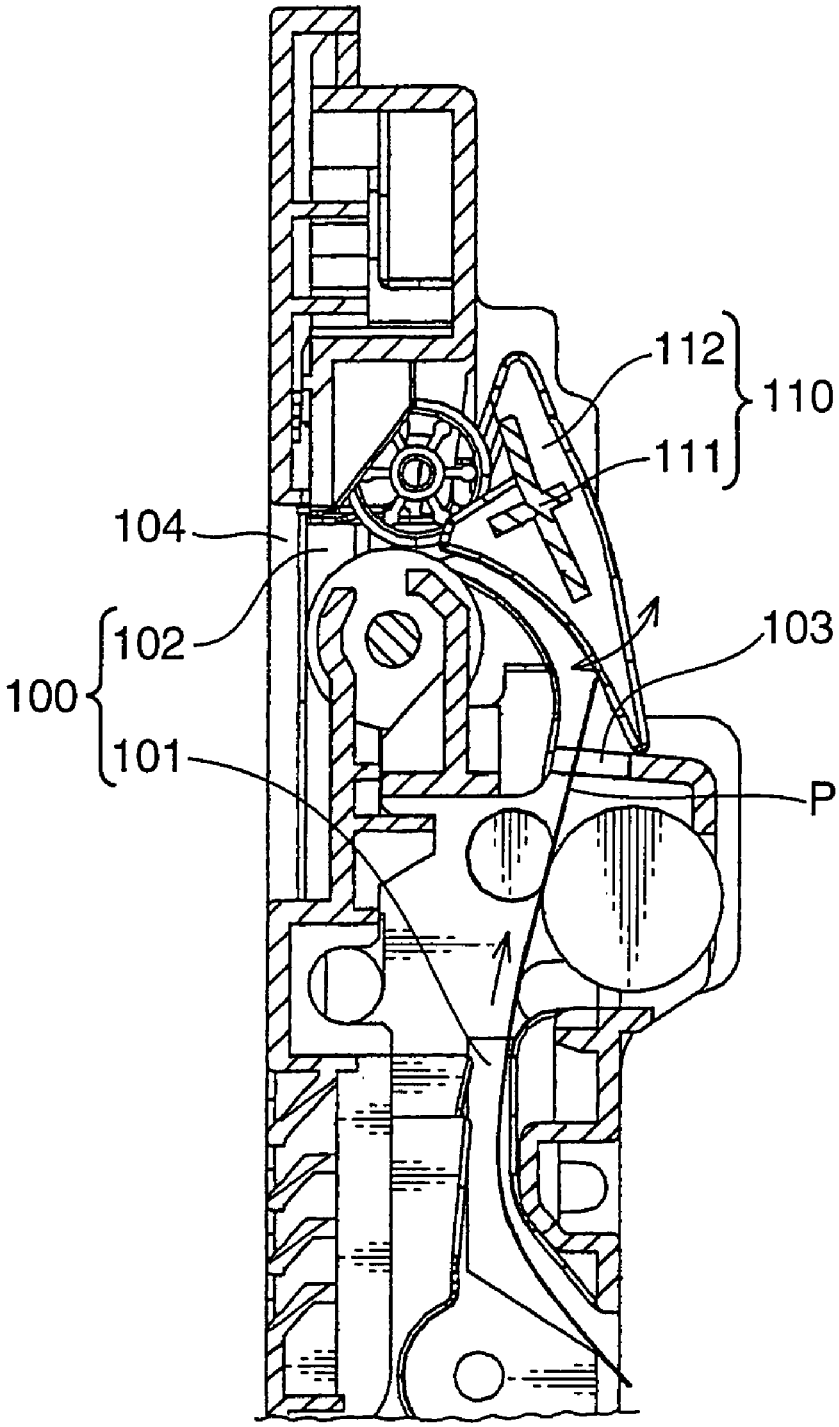
PRIOR ART FIG. 11
FIG. 11 is a sectional side view of a conventional sheet transport path switching mechanism.

The movable guide 40' in the second embodiment is provided at a position just downstream of the post-fixing transport roller 194. The movable guide 40' is operable to selectively introduce either one of two transport paths (or discharging sheet-transport path 61 and reversing sheet-transport path) branched at a position of the movable guide 40' to extend in two directions or upward and downward directions. FIG. 9 is a perspective view of the movable guide 40', seeing from the side of the fixing device 19. FIG. 10 is an enlarged view showing the vicinity of the movable guide 40' in FIG. 8. As shown in FIGS. 9 and 10, an outer transport guide 612 of the discharging sheet-transport path 61 is provided with a contact rib 615 adapted to be brought into contact with the movable guide 40'. The reversing sheet-transport path 60 extends downward through the movable guide 40' to the double-side-printing sheet-reversing section 70, and the discharging sheet-transport path 61 extends toward the upper movable guide 40. The angle of each of the movable guides 40, 40' is changed by a solenoid (not shown) or the like.

An inner transport guide 601, an outer transport guide 602 and a revering transport roller are interposed in the reversing sheet-transport path 60. Each of the inner transport guide 601 and the outer transport guide 602 is a stationary guide having a shape curved convexedly outward relative to the double-side-printing sheet-reversing section 70 located on the downward side in FIG. 8. Thus, when a sheet P passes through the reversing sheet-transport path 60, a printed surface of the sheet P faces to the outer transport guide 602. The reversing transport roller 603 is operable to feed the sheet P to the double-side-printing sheet-reversing section 70. Specifically, the reversing transport roller 603 is provided on the downstream side of the inner transport guide 611 and the outer transport guide 612, and rotationally driven by a drive motor (not shown).

A stationary guide 621 of the facedown sheet-transport path 62 is provided with the same engagement hooks 52 (see FIG. 6) as those in the first embodiment. The engagement hooks 52 are adapted to engage with the upper movable guide 40. The facedown sheet-transport path 62 continuing to the first tray 641 of the discharge section 64 is disposed on the upper side of the upper movable guide 40, and the faceup sheet-transport path 63 continuing to the second discharge tray 642 is disposed on the left side of the upper movable guide 40 in FIG. 8. The details of the upper movable guide 40 are as mentioned above.

A facedown transport roller 622 is interposed in the facedown sheet-transport path 62 to feed a sheet P to the first discharge tray 641 of the discharge section 64. The facedown transport roller 622 is rotationally driven by a motor (not shown).

A faceup transport roller 631 is interposed in the faceup sheet-transport path 63 to feed a sheet P to the second discharge tray 642 of the discharge section 64. The faceup transport roller 632 is rotationally driven by a motor (not shown).

As shown in FIG. 10, the movable guide 40' in the second embodiment (hereinafter referred to as "lower movable guide 407") comprises a cross shaft 45 similar to the cross shaft 41 in the first embodiment, and a plurality of rotary guide fins 48 slightly different in shape from the rotary guide fins 44 in the first embodiment. The cross shaft includes a long/wide plate 46 identical to the long/wide plate 42 in the first embodiment, and a long/narrow plate (base portion) 47 corresponding to the long/narrow plate 43 in the first embodiment. The long/narrow plate 47 protrudes from the approximately central region of the long/wide plate 46 in two opposite directions.

The long/wide plate 46 has a size approximately the same as that of the reversing sheet-transport path 60 and the discharging sheet-transport path 61 in a direction orthogonal to the drawing sheet of FIG. 10. A pair of support shafts 451 are provided at the opposite ends of the cross shaft 451. When the support shafts 451 are supported by the apparatus body 11, the lower movable guide 40' can be rotationally moved about the support shaft 451.

The plurality of rotary guide fins (guide members) 48 are arranged along the longitudinal direction of the long/wide plate 46 at given intervals. Each of the rotary guide fins 48 has an acuminate wedge shape on the side opposed to the fixing device 19, and an acuminate corner 48*c* is formed at the front end of the rotary guide fin 48.

Each of the rotary guide fins 48 has an upper edge formed as a discharging-transport-path-use guide edge 48*a* for guiding a sheet P from the post-fixing transport roller 194 to the discharging sheet-transport path 61, in the state after the rotary guide fins 48 are set up in a downward posture (indicated by the solid line in FIG. 10), and an lower edge formed as a reversing-transport-path-use guide edge 48*b* for guiding a sheet P from the post-fixing transport roller 194 to the reversing sheet-transport path 60, in the state after the rotary guide fins 48 are set up in an upward posture (indicated by the two-dot chain line in FIG. 10).

The acuminate corners 48*c* can be vertically swung to change the angle of the movable guide 40' in the second embodiment so as to selectively take either one of the downward posture where the acuminate corners 48*c* orientate obliquely downward (in this posture, a sheet P is fed to the discharging sheet-transport path 61), and the upward posture where the acuminate corners 48*c* orientate obliquely upward (in this posture, a sheet P is fed to the reversing sheet-transport path 60).

Further, in the second embodiment, an arc-shaped protrusion 471 protruding outward from the upper long/narrow plate 47 is formed in the approximately central region in the longitudinal direction of the lower movable guide 40' and at a position opposed to the acuminate corner 48*c* of the rotary guide fin 48. Further, the outer transport guide 612 is provided with a plurality of stationary fins 614, and a contact rib (restriction member) 613 opposed to the arc-shaped protrusion 471 is provided between two of the adjacent stationary fins 614 at a position corresponding to the central region in the longitudinal direction of the lower movable guide 40'.

As shown in FIG. 10, the contact rib 615 has a uniform shape, seeing from a direction orthogonal to the longitudinal direction of the lower movable guide 40', to act to limit the rotation angle of the lower movable guide 40' within a given range. Specifically, in case where the posture of the lower movable guide 40' is changed to feed a sheet P to the reversing sheet-transport path 60 or the discharging sheet-transport path 61, when a certain force acts on a portion of the lower movable guide 40' ranging from the support shaft 451 to the acuminate corner 48*c* (or the discharging-transport-path-use guide edge 48*a* or the reversing-transport-path-use guide edge 48*b*), the contact rib 615 is brought into contact with the arc-shaped protrusion 471 to prevent the movable guide 40' from being bent or deformed. In addition, the contact rib 615 also has a function of preventing the angle of the movable guide 40' in the second embodiment from being changed clockwise or counterclockwise in FIG. 10 beyond a given value.

According to the transport path switching mechanism according to the second embodiment, the approximately central region in the longitudinal direction of the movable guide 40' disposed at the branch point between the reversing sheet-transport path 60 and the discharging sheet-transport path 61 just downstream of the post-fixing transport roller 194 is pressed by the contact rib 615 provided in the apparatus body 11. Thus, even if a thick sheet P is fed to the movable guide 40' through the post-fixing transport roller 192, the sheet P can be selectively fed either one of the reversing sheet-transport path 60 and the discharging sheet-transport path 61 while reliably preventing the problem of damage or jam of the sheet P due to the bending or deformation in the movable guide 40'

Further, the bending of the movable guide 40' can be prevented by the contact rib 61 provided in the apparatus body 11. Thus, the bending of the movable guide 40' can be suppressed with a simplified structure to achieve cost reduction in the transport path switching mechanism according to the second embodiment.

The present invention is not limited to the above embodiments, but various changes and modifications may be made therein without departing from the spirit and scope thereof as set forth in appended claims.

For example, (1) The first embodiment is constructed such that the engagement finger 52 of the engagement hook 50 is brought into contact with the fulcrum 422 serving as the rotational center of the movable guide 40. However, there are some possibilities that it is difficult to allow the engagement hook 50 to be brought into contact with the rotational center of the movable guide 40. In such cases, the engagement hook 50 may be designed such that the engagement finger 52 is brought into engagement with an appropriate portion of the movable guide 40 only when the movable body 40 is set up at least in the branch posture. Because, when the movable guide 40 is set up in the main posture, the movable guide 40 is never deformed due to the interference with a sheet, and there is no need for taking the measure against the deformation of the movable guide 40 in such a posture.

(2) While the first embodiment employs the pair of engagement hooks 50, the present invention is not limited thereto, but the number of engagement hooks may be one, or 3 or more.

(3) While the first and second embodiments employs the cross shaft 41, 45 as a shaft for supporting the rotary guide fins 44, 48, the present invention is not limited thereto, but the shaft may be formed as a long member having any suitable shape, such as column, triangle pole, square pole or polygonal pole.

(4) While the transport path switching mechanism in the above embodiments is applied to an image forming apparatus 10, such as copying machines or facsimile machines, the present invention is not limited to thereto, but may be applied to any other apparatus for handling sheets or paper, such as printing machines or sorting machines.

As described above, an inventive sheet transport path switching mechanism comprises a movable guide disposed in a sheet transport path inside a given apparatus body and adapted to allow its angular posture to be changed so as to selectively direct a sheet in either one of two different directions, and a restriction member for restricting the bending of the movable guide, the restriction member being located at a position of the apparatus body corresponding to an approximately central region in the longitudinal direction of the movable guide.

With the above mechanism, even if the movable guide is made of a material having a relatively low strength, the restriction member located at a position corresponding to the central region in the longitudinal direction of the movable guide can prevent the bending or deformation of the movable guide. Thus, even a thick and/or firm sheet can be smoothly directed to a desired direction irrespective of contact therewith while effectively preventing damage or jam of the sheet.

In the above sheet transport path switching mechanism, the movable guide may have a base portion and an engagement portion with a through-hole formed in the base portion, and the restriction member may be an engagement hook provided in the apparatus body and adapted to be inserted into the through-hole. The engagement hook provided in the apparatus body can be brought into engagement with the base portion to prevent the bending or deformation of the movable guide. The engagement hook allows the measure against the bending to be flexibly devised.

In the above sheet transport path switching mechanism, the movable guide may have a base portion and a convex portion protruding from the base portion, and the restriction member may be a contact rib provided in the apparatus body and adapted to be brought into contact with the convex portion. The contact rib provided in the apparatus body can be brought into contact with the base portion to prevent the bending or deformation of the movable guide.

In the case where the engagement hook is used as the restriction member, the sheet transport path may include a main transport path formed in the apparatus body to extend vertically, and a branch transport path branched from the main transport path at a given branch point. The movable guide may be adapted to be rotatably moved about its axis parallel to the width direction of the main transport path so as to selectively take either one of a main posture where the movable guide directs a sheet to the downstream side of the main transport path relative to the branch point, and a branch posture where the movable guide directs a sheet to the branch transport path. Further, the movable guide may include a plurality of guide members arranged on the base portion in parallel with each other. According to this structure, in a sheet transport path including a vertically extending main transport path and a branch transport path branched from the main transport path at a given branch point, even if a thick and/or firm sheet reached the movable guide set up in the branch posture and presses the movable guide, the engagement hook can restrict the axial position of the movable guide to effectively prevent the movable guide from being deformed due to the interference with the sheet fed to the branch transport path so as to allow the sheet to be smoothly directed and fed to the branch transport path without sheet jam.

Further, the main transport path may be formed to extend approximately vertically, and the branch transport path may be formed to extend approximately horizontally. This can meet the need for switchably discharging sheet both to the upper and side surfaces of the apparatus body.

In the case where the contact rib is used as the restriction member, the sheet transport path may include a main transport path formed in the apparatus body to extend upward from a given branch point, and an auxiliary transport path formed in the apparatus body to extend downward from the branch point. The movable guide may be adapted to be rotatably moved about its axis parallel to the width direction of the main transport path so as to selectively take either one of a main posture where the movable guide directs a sheet to the downstream side of the main transport path relative to the branch point, and an auxiliary posture where the movable guide directs a sheet to the auxiliary transport path. Further, the movable guide may include a plurality of guide members arranged on the base portion in parallel with each other. According to this structure, in a sheet transport path including a main transport path extending upward from a given branch point and an auxiliary transport path extending downward from the branch point, even if a thick and/or firm sheet reached the movable guide set up in the auxiliary posture and presses the movable guide, the contact rib can restrict the axial position of the movable guide to effectively prevent the movable guide from being deformed due to the interference with the sheet fed to the main or auxiliary transport path so as to allow the sheet to be smoothly directed and fed to the main or auxiliary transport path without sheet jam.

In the above sheet transport path switching mechanism, the movable guide may be made of only a synthetic resin material. The movable guide which does not use any other material, such as metal, in combination with the synthetic resin material can contribute to the reduction in material cost and production cost. Further, when discarded, the movable guide is desirable in view of waste treatment.

Further, the apparatus body may be used in an image forming apparatus, and may include a fixing device. In this case, the transport path may be adapted to transport a sheet fed from the fixing device. The transport switching mechanism can achieve an adequate discharge operation for a fixed sheet in an image forming apparatus.

This application is based on patent application No. 2003-124267 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet transporting apparatus comprising:

a main body;

a sheet transport path defined inside the main body for transporting a sheet;

a movable guide disposed in the sheet transport path, an angular posture of the movable guide being changeable; and a restriction member disposed on the main body along a longitudinal direction of the movable guide for restricting a bending of the movable guide.

2. The sheet transporting apparatus as defined in claim 1, wherein the movable guide is changeable to two different directions to direct a sheet in a selective direction.

3. The sheet transporting apparatus as defined in claim 1, wherein the restriction member is located at a position substantially corresponding to a longitudinally center of the movable guide.

4. The sheet transporting apparatus as defined in claim 1, wherein:

the movable guide includes a base portion and an engagement portion having a through-hole formed in the base portion; and the restriction member is an engagement hook provided on the main body and insertable in the through-hole.

5. The sheet transporting apparatus as defined in claim 4, wherein:

the sheet transport path includes a main transport path formed in the main body and extending in a vertical direction, and a branch transport path branched from the main transport path at a given branch point; and the movable guide is rotatable about an axis parallel to a width direction of the main transport path so as to change from a main posture of directing a sheet to the main transport path downstream of the branch point to a branch posture of directing a sheet to the branch transport path, and vice versa, the movable guide including a plurality of guide members arranged on the base portion in parallel with each other.

6. The sheet transporting apparatus as defined in claim 5, wherein the main transport path extends in a substantially vertical direction, and the branch transport path extends a substantially horizontal direction.

7. The sheet transporting apparatus as defined in claim 1, wherein:

the movable guide includes a base portion and a contact portion provided at a predetermined location of the base portion; and the restriction member is a projection provided on the main body and operable to come into contact with the contact portion.

8. The sheet transporting apparatus as defined in claim 7, wherein:

the contact portion has a convex portion protruding from the base portion; and the projection is an engagement rib engageable with the convex portion.

9. The sheet transporting apparatus as defined in claim 7, wherein:

the sheet transport path includes a main transport path extending upward from a given branch point provided in the main body, and an auxiliary transport path extending downward from the branch point; and the movable guide is rotatable about an axis parallel to a width direction of the main transport path so as to change from a main posture of directing a sheet to the main transport path downstream of the branch point, and an auxiliary posture of directing a sheet to the auxiliary transport path, the movable guide including a plurality of guide members arranged on the base portion in parallel with each other.

10. The sheet transporting apparatus as defined in claim 1, wherein the movable guide consists of a synthetic resin material.

11. A sheet transporting apparatus comprising:

a main body;

a sheet transport path defined inside the main body for transporting a sheet;

a movable guide disposed in the sheet transport path, and having a longitudinal axis extending substantially transverse to the sheet transport path, and being rotatable about the longitudinal axis for changing the angular posture of the movable guide, and including a base portion and at least one through-hole formed in the base portion; and an engagement hook provided in the main body and insertable in the through-hole to restrict a bending of the movable guide, and located at a predetermined position along the longitudinal axis of the movable guide.

12. A sheet transporting apparatus comprising:

a main body;

a sheet transport path defined inside the main body for transporting a sheet;

a movable guide disposed in the sheet transport path, and having a longitudinal axis extending substantially transverse to the sheet transport path, and being rotatable about the longitudinal axis for changing the angular posture of the movable guide, and including a base portion and a contact portion provided at a predetermined location of the base portion; and an engagement rib provided in the main body and operable to come into contact with the contact portion, and located at a predetermined position along the longitudinal axis of the movable guide.

13. An image forming apparatus comprising:

an image forming unit for forming a toner image on a sheet;

a fixing device for fixing the toner image on the sheet;

a sheet transport path for transporting the sheet fed from the fixing device;

a movable guide disposed in the sheet transport path, and having a longitudinal axis extending substantially transverse to the sheet transport path, and being rotatable about the longitudinal axis for changing the angular posture of the movable guide; and a restriction member disposed at a predetermined position along the longitudinal axis of the movable guide for restricting a bending of the movable guide.

14. The image forming apparatus as defined in claim 13, wherein the movable guide is changeable to two different directions to direct a sheet in a selective direction.

15. The image forming apparatus as defined in claim 13, wherein the restriction member is located at a position substantially corresponding to a longitudinally center of the movable guide.

16. The image forming apparatus as defined in claim 13, wherein:

the movable guide includes a base portion and an engagement portion having a through-hole formed in the base portion; and the restriction member is an engagement hook provided on a main body of the image forming apparatus and insertable in the through-hole.

17. The image forming apparatus as defined in claim 13, wherein:

the movable guide includes a base portion and a contact portion provided at a predetermined location of the base portion; and the restriction member is a projection provided on a main body of the image forming apparatus and operable to come into contact with the contact portion.

18. The image forming apparatus as defined in claim 17, wherein:

the contact portion has a convex portion protruding from the base portion; and the projection is an engagement rib engageable with the convex portion.

19. The image forming apparatus as defined in claim 13, wherein the movable guide consists of a synthetic resin material.

* * * * *